US008272391B2

(12) United States Patent
Luo

(10) Patent No.: US 8,272,391 B2
(45) Date of Patent: Sep. 25, 2012

(54) AUTO BENDING STRUCTURE OF SUNSHADE

(76) Inventor: Xiong Luo, Ningbo (CN)

( * ) Notice: Subject to any disclaimer, the term of this patent is extended or adjusted under 35 U.S.C. 154(b) by 0 days.

(21) Appl. No.: 12/954,887

(22) Filed: Nov. 28, 2010

(65) Prior Publication Data

US 2011/0126870 A1 Jun. 2, 2011

(30) Foreign Application Priority Data

Nov. 30, 2009 (CN) ..... 2009 2 0201601 U
Oct. 8, 2010 (CN) ..... 2010 2 0556192 U

(51) Int. Cl.
*A45B 17/00* (2006.01)

(52) U.S. Cl. ..... 135/20.1; 135/20.3

(58) Field of Classification Search ..... 135/20.1, 135/20.3; 248/514
See application file for complete search history.

(56) References Cited

U.S. PATENT DOCUMENTS 2,721,569 A * 10/1955 Militano ..... 135/20.3
3,150,671 A * 9/1964 Frey ..... 135/20.3
4,582,078 A * 4/1986 Ma ..... 135/20.3
4,878,509 A * 11/1989 Tung ..... 135/20.3
5,029,596 A * 7/1991 Tung ..... 135/20.3
6,446,650 B1 * 9/2002 Ma ..... 135/20.3
6,575,182 B2 * 6/2003 Tung ..... 135/20.1
6,622,741 B2 * 9/2003 Lai ..... 135/20.3
6,810,892 B2 * 11/2004 Lai ..... 135/20.3

FOREIGN PATENT DOCUMENTS

CN 00249751.4 8/2001

* cited by examiner

*Primary Examiner* — Noah Chandler Hawk
(74) *Attorney, Agent, or Firm* — Global IP Services; Tianhua Gu

(57) ABSTRACT

An auto bending structure of sunshade has an upper section of bending and a lower section of bending, which are connected by a sliding rod with a top through hole and a bottom through hole. The bottom through hole has a guide pin sliding in an arc groove provided on the scarf joint part of the lower section of bending, linear groves corresponding to the arc groove are provided on both sides of the groove of the upper section of bending. A sliding sleeve with a bottom through hole is provided on the top of said sliding rod, the bottom through hole of said sliding sleeve is corresponding to the top through hole of the sliding rod. The upper section of umbrella stem is provided with a linear groove which is surrounded by a ring, the ring is connected with the sliding rod and sliding sleeve by the connecting pin, which slides in the linear groove to make the ring to cooperate with the lower nest moving up and down as pulled by the umbrella string.

8 Claims, 13 Drawing Sheets

AUTO BENDING STRUCTURE OF SUNSHADE

CROSS REFERENCE TO RELATED PATENT APPLICATION

The present invention claims the priority of Chinese Patent No. 201020556192.1 filed on Oct. 8, 2010, which application is incorporated herein by reference.

FIELD OF THE INVENTION

The present invention relates to an automatic bending structure of an auto bending structure of sunshade.

BACKGROUND OF THE INVENTION

A traditional sunshade bending positioning device consists of the upper protruding connector, lower concave connector, the positioning rod, the spring pin and the spring, etc. The biggest disadvantage of the traditional bending device is that the bending angle of the upper protruding connector cannot reach the proper angle for scarf joint due to the load of the sunshade supported by the upper umbrella stem, in particular, due to the load of the sunshade, excessive bending will be caused once the scarf rod is detached from the scarf slot, which will cause difficulty in scarf joint.

The auto bending mechanism for sunshade of the patent number 00249751.4 is created to solve this problem, this structure comprises the upper section of bending and the lower section of bending, said upper section of bending being a cylinder with both sides provided with flat scarf joint parts, a through hole is provided in the scarf joint part and the other end is a round pipe; said lower section of bending being also a cylinder with a groove on the top fitting the scarf joint part of the upper section of bending, and scarf joint ribs symmetric on both sides are formed, one pair of ribs are provided with through holes for fixing pin, scarf joint part of the upper section of bending is engaged in the slot of the lower section of bending and is connected with a pin, this device features that: a groove is provided on the scarf joint part of the upper section of bending, an internal spring is provided in the groove, and a pin pivotally connecting the upper section of bending and the lower section of bending passes through the internal spring, a bending connecting rod is placed in the pivotally connected upper section of bending and lower section of bending with the bottom located at the bottom of the lower section of bending, the connecting rod is provided at the end with 2 pulleys connected by a sliding pin, a groove for the pulleys to slide on is provided in the lower section of bending at the bottom of the slot, a positioning plug is fixed on the top of the connecting rod, the top of said positioning plug is fixed with a return spring for fixing with the upper section of umbrella stem, a pulley is mounted in the upper section above of the spring, one end of the umbrella string is connected with the lower nest, another end is connected with the rotating handle after passing the pulley and passing through the return spring, upper section of bending and lower section of bending in order. It is advantageous in graceful appearance, simple operation, durability and the ability of free positioning within the range of 0~28°, however, it is disadvantageous in complicated structure, high production cost, lack of a labor-saving mechanism, inflexible rotation etc. and needs to be improved.

SUMMARY OF THE INVENTION

The present invention is firstly intended to provide an auto bending structure of sunshade with simpler structure and lower cost according to the current arts.

Another technical problem for the present invention is to provide an auto bending structure of sunshade that is labor saving and capable of flexible rotation according to the current arts.

The solution for the present invention to solve the technical problems above is: an auto bending structure of sunshade comprising: an upper section of bending and an lower section of bending, both sides of one end of said lower section of bending are cut even into a flat scarf joint part, which is provided with a through hole in the middle; the bottom of said upper section of bending is provided with a groove corresponding to said scarf joint part, through holes are provided on both sides of said groove, the scarf joint part of said lower section of bending scarfed in said groove for movable riveting of said lower section of bending and said upper section of bending, a return spring is provided at the upper section of the stem, one end of the umbrella string is fixed with a lower nest, and the other end of the umbrella string is connected with a rotating handle after passing a fast pulley in the upper section of umbrella stem and passing through the return spring, the upper section of bending and the lower section of bending in order, said structure features: a sliding rod is placed in the pivotally connected upper section of bending and lower section of bending, through holes are provided on the bottom and top of said sliding rod, a guide pin is provided at the through hole on the bottom of said sliding rod, an arc groove for said guide pin to slide on is provided on the scarf joint part of the lower section of bending, linear groves corresponding to said arc groove for said guide pin to slide on are provided on both sides of said groove of the upper section of bending, a sliding sleeve with a through hole on the bottom is provided on the top of said sliding rod, said through hole on the bottom of said sliding sleeve corresponds to the through hole on the top of said sliding rod, correspondingly, the upper section of umbrella stem is provided with a linear groove on the outer wall and is surrounded by a ring, which is connected with the sliding rod and the sliding sleeve with the connecting pin, which slides in the linear groove to make the ring cooperate with the lower nest moving up and down and pulled by the umbrella string.

Preferably, said upper section of umbrella stem is provided with a through hole on the top, a fixing pin is provided at the through hole of said upper section of umbrella stem, said fixing pin connects said return spring and said upper section of umbrella stem.

Preferably, said return spring directly push against the top of said sliding sleeve.

Finally, said sliding rod is with an arc.

The technical solution of the present invention to solve the other technical problem above is: an auto bending structure of sunshade, comprising an upper section of bending and an lower section of bending, both sides of one end of said lower section of bending are cut even into a flat scarf joint part, which is provided with a through hole in the middle; the bottom of said upper section of bending is provided with a groove corresponding to said scarf joint part, through holes are provided on both sides of said groove, the scarf joint part of said lower section of bending inserted in said groove for movable riveting of said lower section of bending and said upper section of bending, a return spring is provided at an upper section of the stem, one end of an umbrella string is fixed with a lower nest, and the other end of said umbrella string is connected with a rotating handle after passing a fast pulley in the upper section of umbrella stem and passing through the return spring, the upper section of bending and the lower section of bending in order, said structure features: a sliding rod is placed in the pivotally connected upper section of bending and lower section of bending, through holes are provided on the bottom and top of said sliding rod, a guide pin is provided at the through hole on the bottom of said sliding rod, an arc groove for said guide pin to slide on is provided is on the scarf joint part of the lower section of bending, linear groves corresponding to said arc groove for said guide pin to slide on are provided on both sides of said groove of the upper section of bending, inside the upper section of umbrella stem, a fixed plug and a upper sliding plug capable of moving up and down are provided, said fixed plug is provided with a through hole on the upper part and is connected with the upper section of umbrella stem and the ring around said upper section of umbrella stem with a rivet, the lower part of said upper sliding plug and the top of said sliding rod are pivotally connected, through holes are provided on said fixed plug and upper sliding plug for the umbrella string to pass through, the upper return spring is mounted between said fixed plug and said upper sliding plug, the umbrella string at least passes through said fixed plug, the upper return spring and the upper sliding plug in order before being connected with a rotating handle to make the ring cooperate with the lower nest moving up and down and pulled by the umbrella string so as to realize direction adjustment between said upper section of bending and said lower section of bending.

As a further improvement, said fixed plug is provided with a pulley groove on the bottom, in which at least one pulleys are placed, said upper sliding plug is provided with a pulley groove on the top, in which at least one pulleys are placed for pivotal connection with said upper sliding plug, the number of pulleys of the fixed plug corresponds to that of the pulley of said upper sliding plug to allow the umbrella string to pass the pulleys of the fixed plug and the upper sliding plug.

Preferably, said fixed plug has a pair of pulleys, one large and one small, with the large pulley on the top and the small pulley on the bottom; correspondingly, the upper sliding plug also has a pair of pulleys, one large and one small, with the small pulley on the top and the large pulley on the bottom.

As a further improvement, the bottom of said sliding rod is pivotally connected with the top of said first connecting rod, while the bottom of said first connecting rod is pivotally connected with the top of the second connecting rod in the lower section of the umbrella stem, the bottom of said second connecting rod is pivotally connected with the lower sliding plug in the lower section of the umbrella stem, the lower return spring is supported between the lower section of bending and the lower sliding plug. Thus, the return spring force is increased with the connecting rod and the lower return spring so that the direction adjustment between the upper section of bending and the lower section of bending is easier.

As an improvement, said fixed plug is provided with a boss at the bottom, said upper sliding plug is provided with a boss on the top, and the upper return spring is provided between the bosses.

Preferably, said fast pulley is provided in the pulley groove of the upper section of umbrella stem and pivotally connects the fast pulley in the upper section of umbrella stem with a rivet.

Preferably, said upper sliding plug is provided with a rectangular groove at the bottom for insertion of the top of the sliding rod, and a through hole is provided in the vertical direction, said through hole is aligned with the through hole on the top of said sliding rod and connected with a connecting pin.

Finally, said sliding rod is with an arc.

Compared with existing technologies, the present invention is advantageous in that: in the steering mechanism, not so many pulleys, torsion springs and other elastic parts are required, and thus fewer parts, simpler structure and lower cost are achieved; in particular, it is provided with the pulley-type labor saving mechanism and integrates the upper and lower return springs as well as the upper and lower sliding plug, therefore, the whole structure can allow smooth and labor-saving operation of the umbrella, besides, since the umbrella string is wound for multiple times, the sliding rod will move a unit distance after the umbrella string moving multiple units of distance, thus ensuring more balanced bending and make the whole mechanism more practical.

DETAIL DESCRIPTION OF THE INVENTION

Detailed description of the present invention will now be given below according to the drawings.

Embodiment 1

Figure 1:
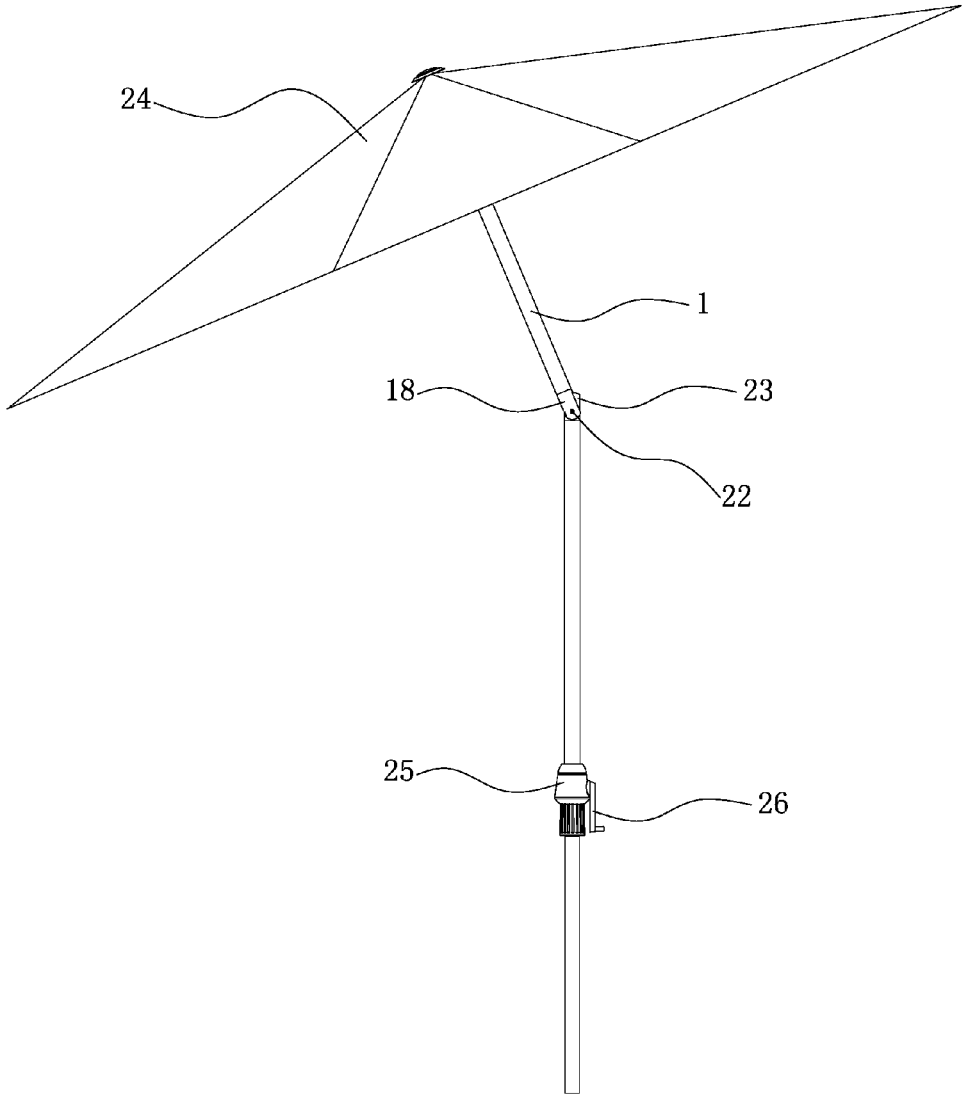
FIG. 1 is the structural diagram of the sunshade for the present invention.
Figure 2:
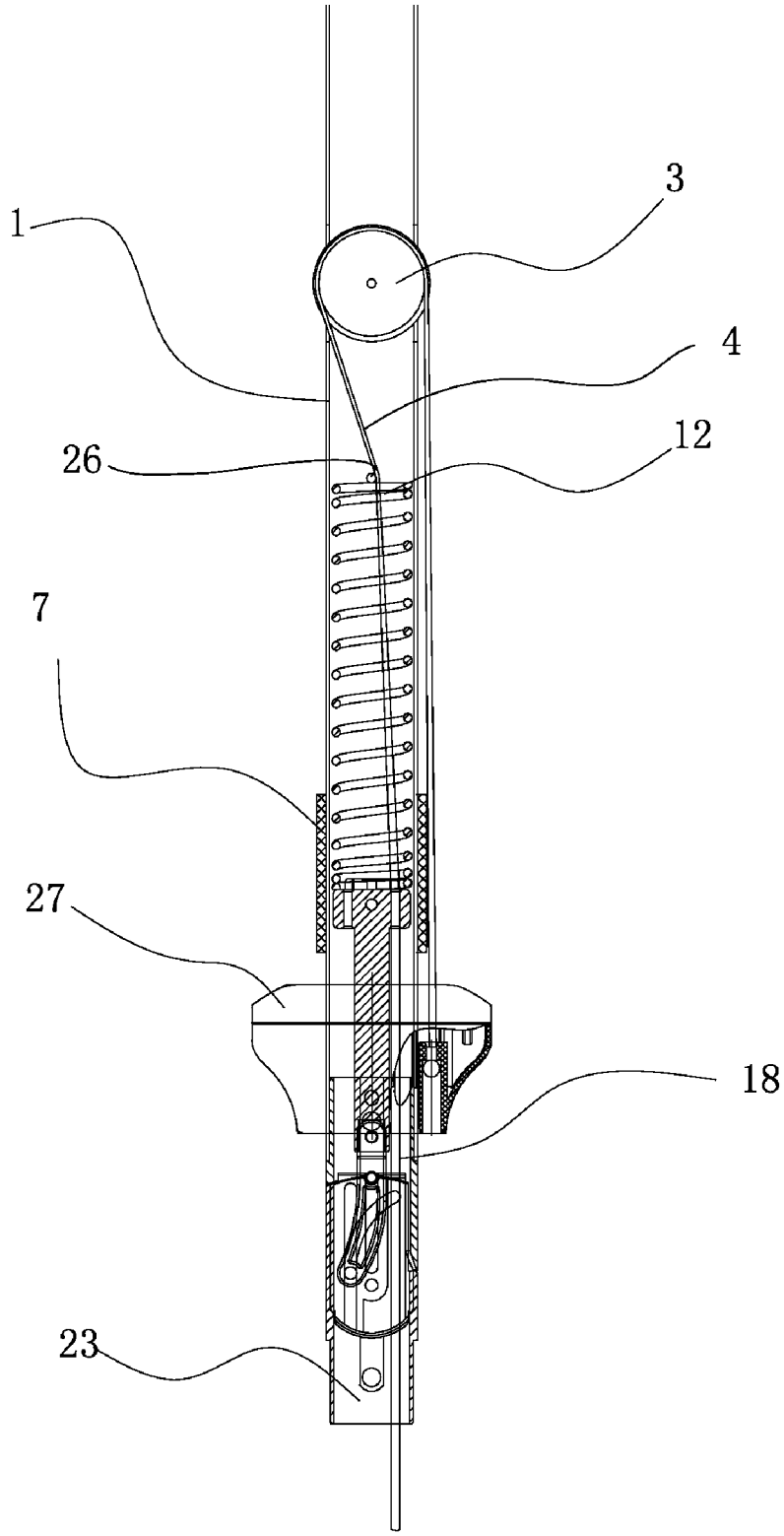
FIG. 2 is the structural diagram of embodiment 1 of the present invention.
Figure 3:
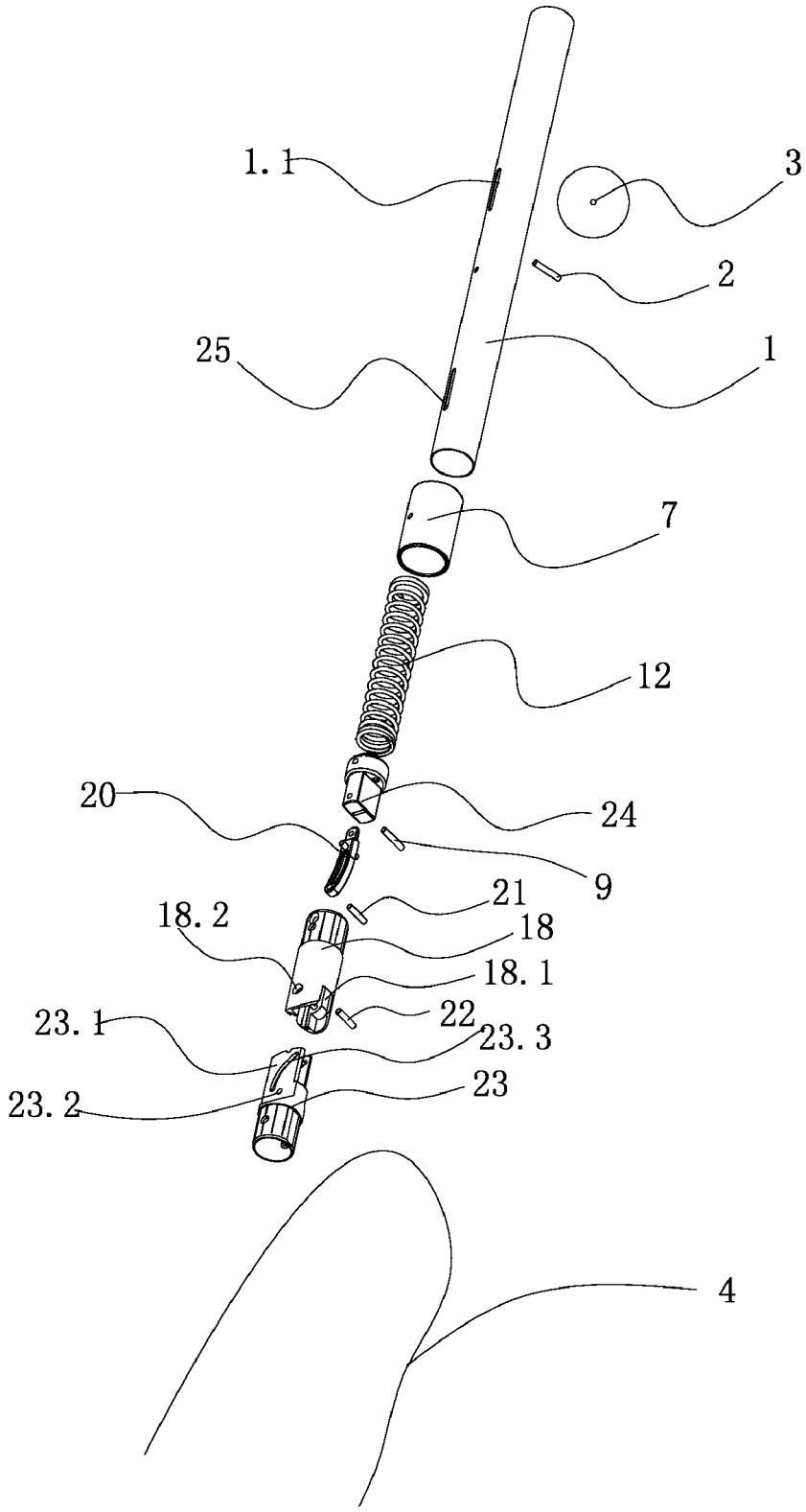
FIG. 3 is the 3D exploded view of embodiment 1 of the present invention.
Figure 4:
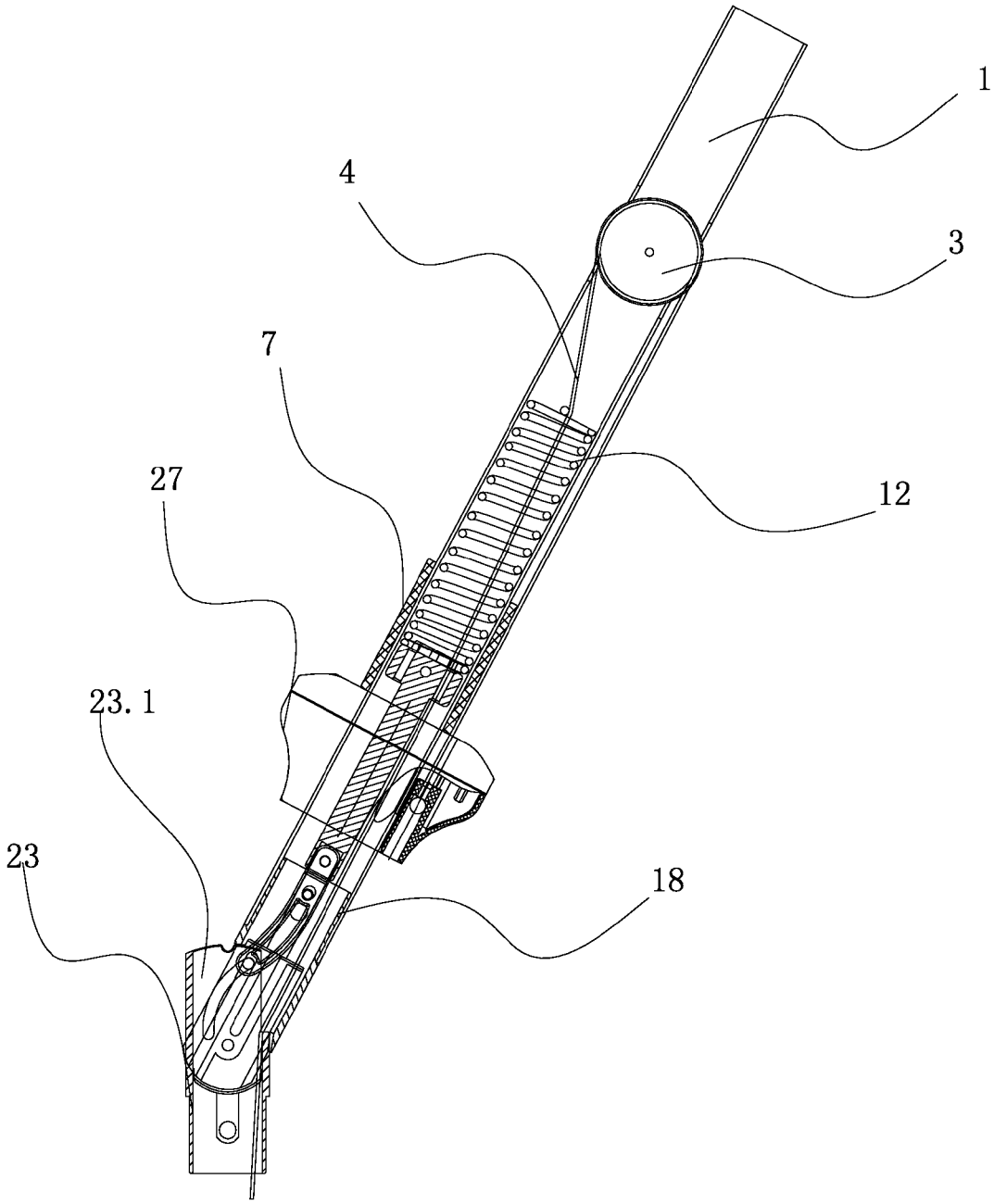
FIG. 4 is the structural diagram of embodiment 1 of the present invention when bended.
Figure 5:
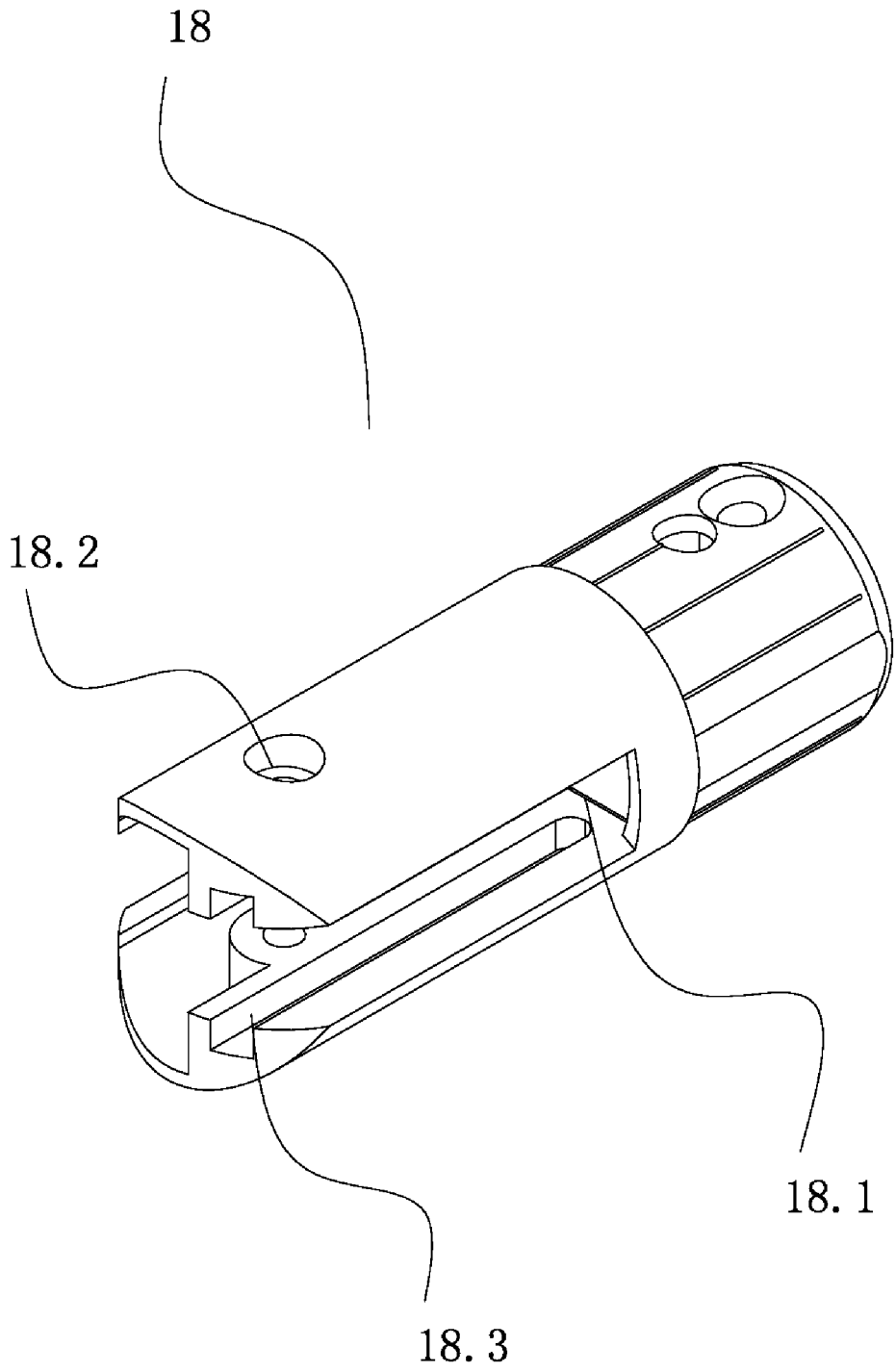
FIG. 5 is the 3D diagram for the upper section of bending in FIG. 3.

As shown in FIGS. 1-5, an auto bending structure of sunshade comprises the upper section of bending 18, lower section of bending 23, upper section of umbrella stem 1 and umbrella string 4, etc, both sides of one end of lower section of bending 18 are cut even into a flat scarf joint part 23.1, which is provided with a through hole 23.2 in the middle, 2 arc groove 23.3 are provided on both sides of the scarf joint part 23.1 of said lower section of bending 23, a slot 18.1 is provided on the top of said upper section of bending 18, said slot 18.1 corresponds to the scarf joint part 23.1 of said lower section of bending 23, through holes 18.2 are provided on both sides of slot 18, scarf joint part 23.1 of said lower section of bending 23 is embedded in slot 18.1, pivotally connected the lower section of bending 23 and upper section of bending 18 with the rivet 22 so allow rotation between said lower section of bending 23 and upper section of bending 18, slot 18.1 of the upper section of bending 18 is also provided with 2 linear groove 18.3 corresponding to arc groove 23.3 of lower section of bending 23 on both sides, a sliding rod 20 is provided in the pivotally connected upper section of bending 18 and lower section of bending 23 with an arc, through holes are provided on the top and bottom of the sliding rod 20, a guide pin 21 is equipped in said bottom through hole, said guide pin 21 may move in the linear groove 18.3 of said upper section of bending 18 and the arc groove 23.3 of said lower section of bending 23, said sliding rod 20 is provided with a sliding sleeve 24 on the top, and the sliding sleeve 24 is provided with a through hole at the bottom, the bottom through hole of said sliding sleeve 24 corresponds to the through hole on the top of said sliding rod 20, said upper section of umbrella stem 1 is provided with a linear groove 25 on the outer wall and is surrounded by a plastic ring 7, a return spring 12 is provided inside the upper section of umbrella stem 1, and the sliding rod 20, sliding sleeve 24 and plastic ring 7 are connected with the connecting pin 9, a linear groove is provided at the bottom of said upper section of umbrella stem 1 corresponding to the connecting pin 9 for the connecting pin 9 to slide on, thus, the sliding rod 20, the sliding sleeve 24 and the plastic ring 7 can move up and down in the linear groove through the connecting pin 9 so as to pull the guide pin 21 and press the return spring 12, the top of the return spring 12 is connected with the upper section of umbrella stem 1 via the pin 26, the bottom of the return spring 12 directly push against the top of the sliding sleeve 24. The top of said upper section of umbrella stem 1 is correspondingly provided with a linear pulley groove 1.1 for the fast pulley 3 to be exposed and rotate, said fast pulley 3 is fixed on the top of the upper section of umbrella stem 1 via a pin, one end of said umbrella string 4 is fixed with the lower nest 27, and the other end is connected with the rotating handle via the fast pulley 3 as well as the return spring 12, the upper section of bending 18 and the lower section of bending 23 in order, the rotating handle is not indicated in the figure, and the umbrella string 4 pulls the lower nest 27 to move upwards and push the plastic ring 7 to move upwards so as to drive the motion of the guide pin 21 and to make the upper section of bending 18 gradually deflect in relation to the lower section of bending 23 till the bending is achieved.

Embodiment 2

Figure 6:
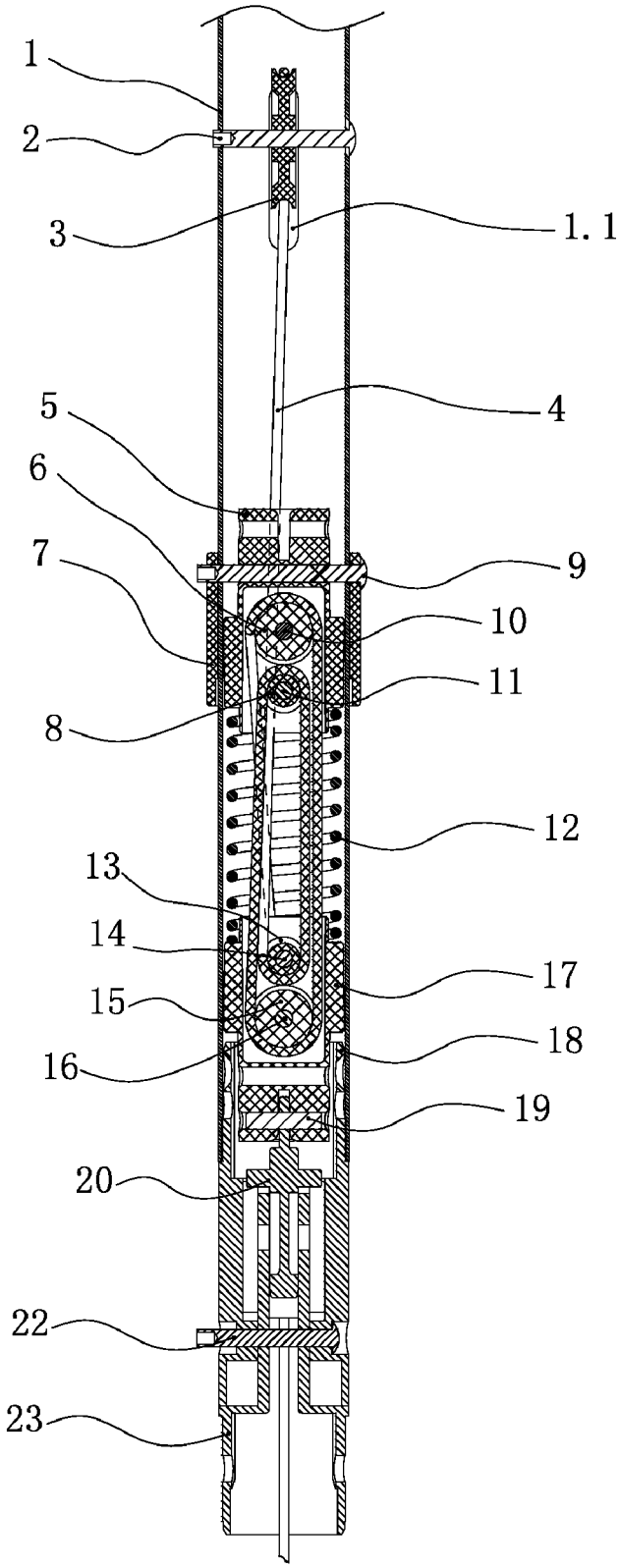
FIG. 6 is structural cutaway view 1 of embodiment 2 of the present invention.
Figure 7:
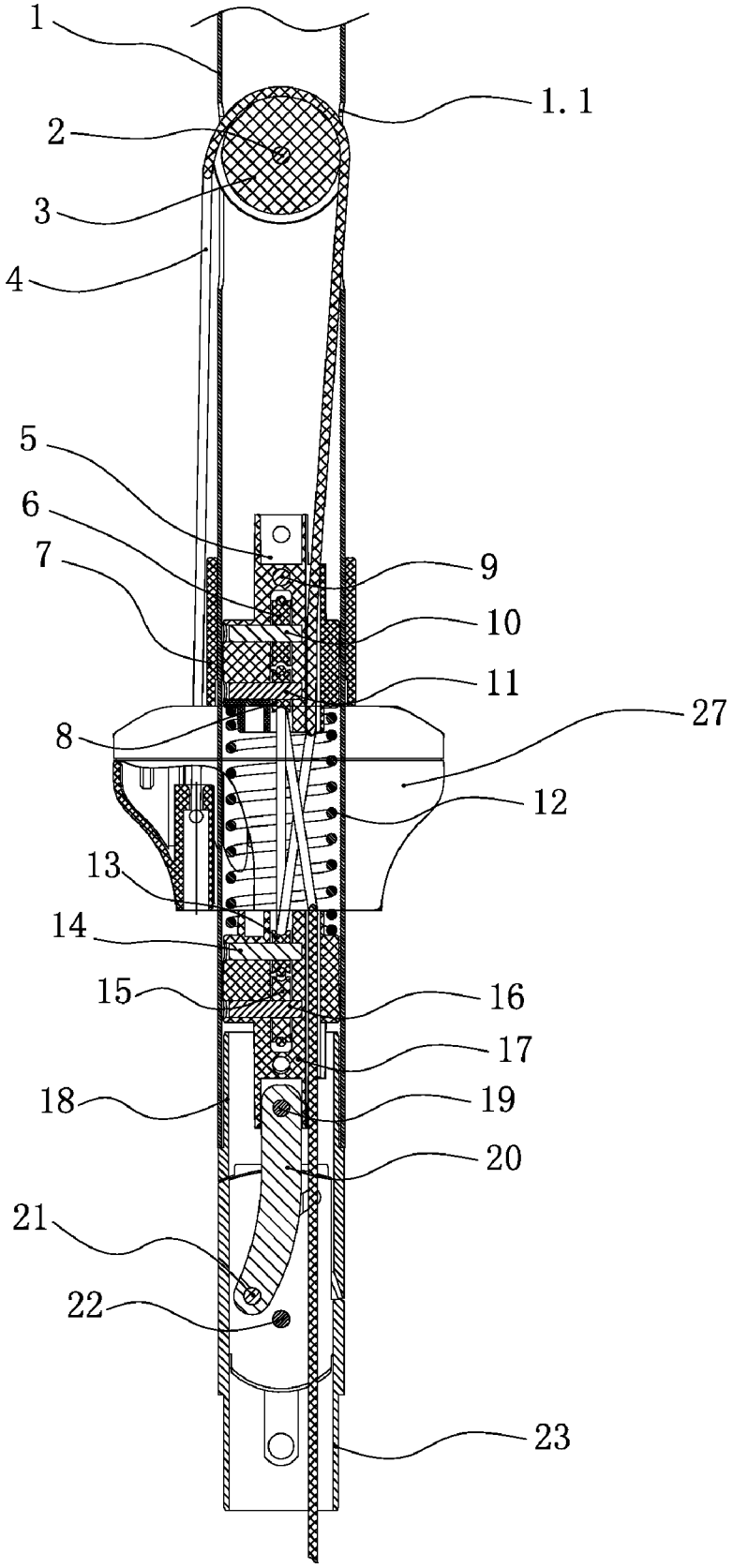
FIG. 7 is structural cutaway view 2 of embodiment 2 of the present invention.
Figure 8:
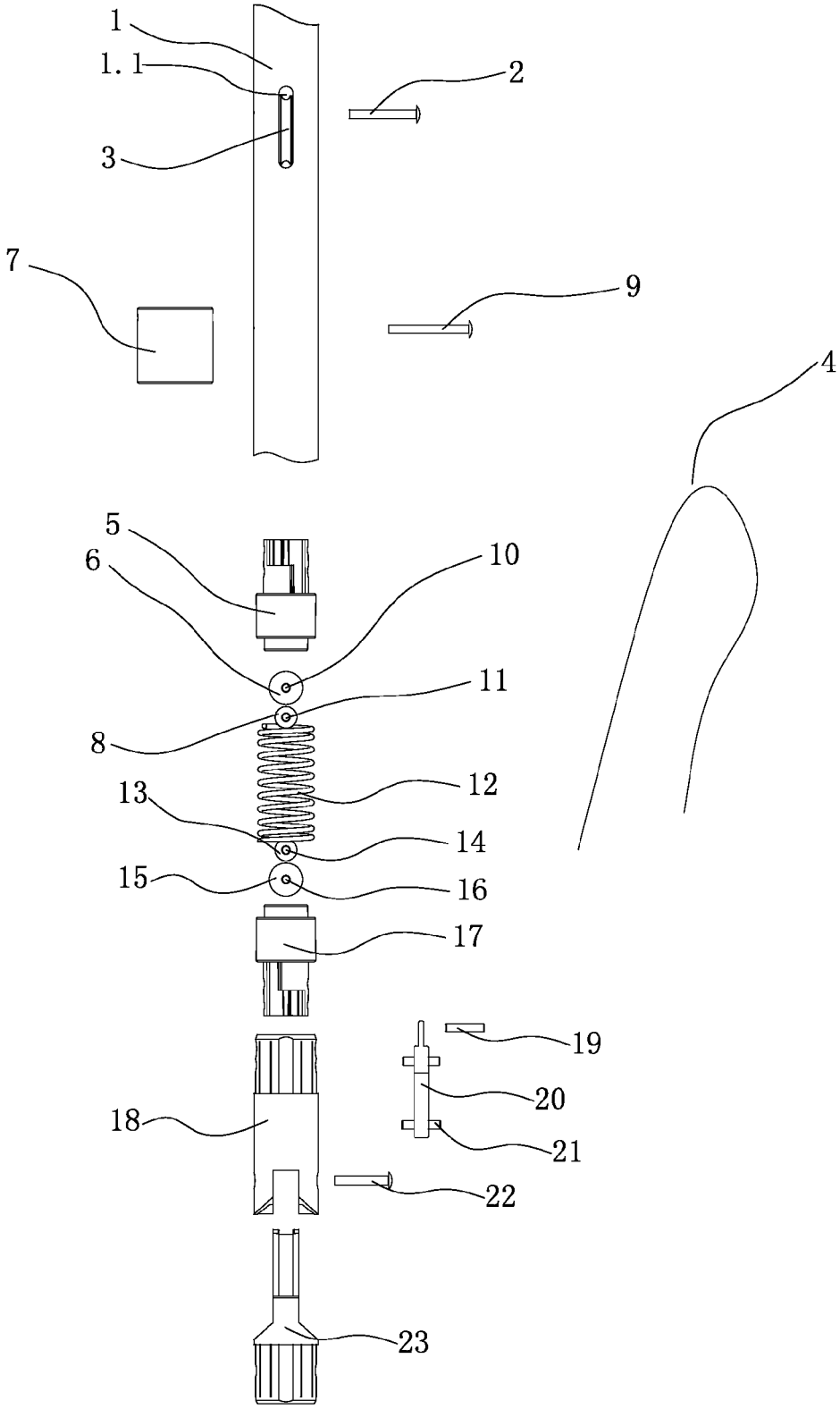
FIG. 8 is structural exploded view 1 of embodiment 2 of the present invention.
Figure 9:
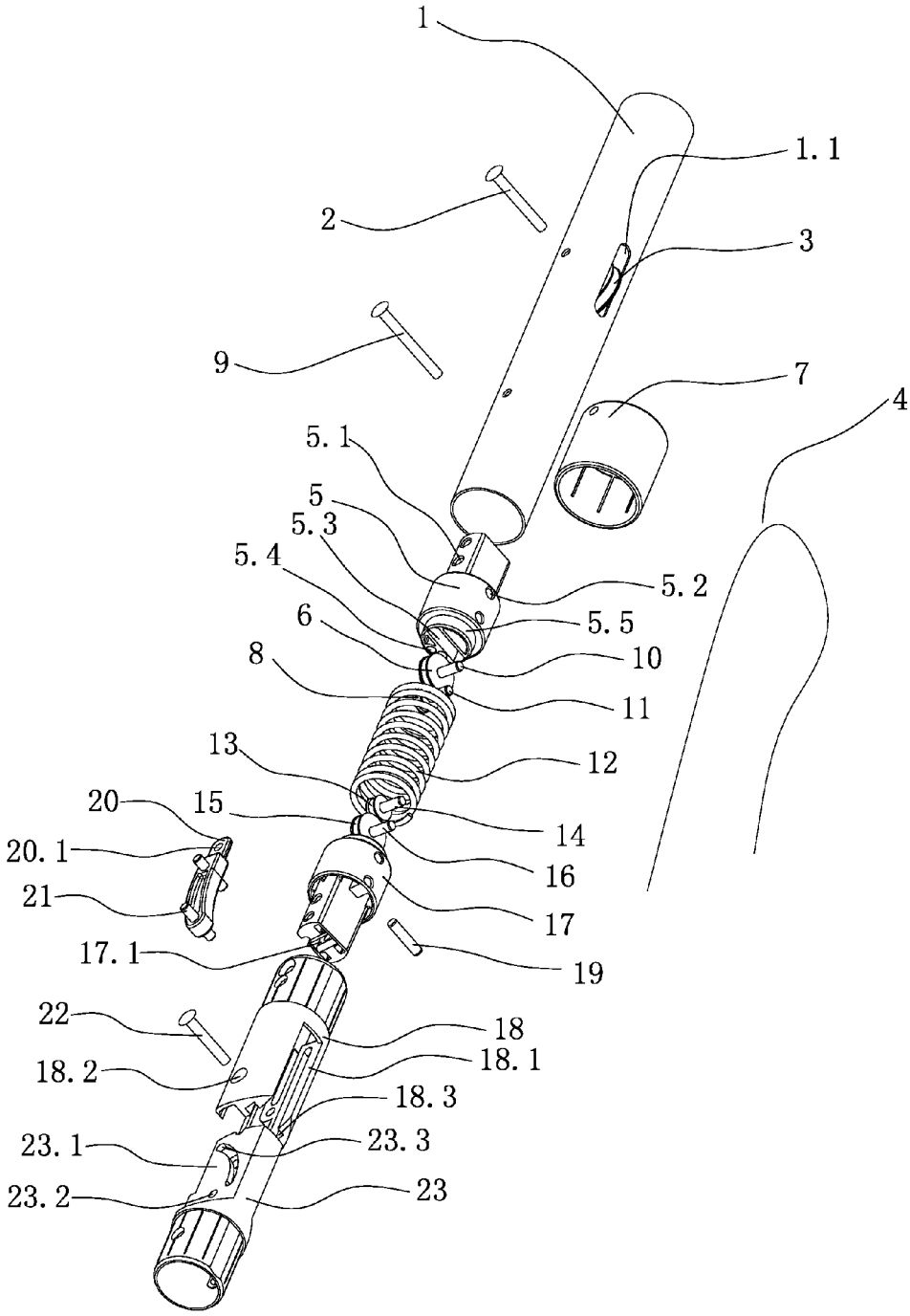
FIG. 9 is structural exploded view 2 of embodiment 2 of the present invention.

As shown in FIGS. 6-9, said auto bending structure of sunshade comprises the upper section of bending 18, lower section of bending 23, upper section of umbrella stem 1, fixed plug 5, upper sliding plug 17, the umbrella string 4, the umbrella fabric 24 and the umbrella frame, etc.

Both sides of one end of the lower section of bending 23 are cut even into a flat scarf joint part 23.1, which is provided with a through hole 23.2 in the middle, 2 arc groove 23.3 are provided on both sides of the scarf joint part 23.1 of said lower section of bending 23, a slot 18.1 is provided on the top of said upper section of bending 18, said slot 18.1 and scarf joint part 23.1 of said lower section of bending 23 are corresponding, through holes 18.2 are provided on both sides of slot 18, s scarf joint part 23.1 of said lower section of bending 23 is embedded in slot 18.1, through hole 23.2 passing through the lower section of bending 23 via rivet 22 and the through hole 18.2 of the upper section of bending 18 pivotally connected the lower section of bending 23 and the upper section of bending 18 to allow rotation between said lower section of bending 23 and upper section of bending 18, upper section of bending slot 18.1 is also provided with 2 linear groove 18.3 corresponding to the arc groove 23.3 of lower section of bending 2, a sliding rod 20 is provided in the pivotally connected upper section of bending 18 and lower section of bending 23, said sliding rod 20 is with an arc, through holes are provided at the bottom and on the top of the sliding rod 20, a guide pin 21 is equipped in said bottom through hole, said guide pin 21 can be inserted in the linear groove 18.1 of said upper section of bending 18 and the arc groove 23.3 of said lower section of bending 23.

A fast pulley 3 is placed in the pulley groove 1.1 of said upper section of umbrella stem 1 and fixed with the rivet 2 to allow the fast pulley 3 to be pivotally connected in the upper section of umbrella stem 1.

The fixed plug 5 is provided in the upper section of umbrella stem 1 below the fast pulley 3, said fixed plug 5 is provided with a through hole on the top and is connected with the upper section of umbrella stem 1 and the ring 7 around the upper section of umbrella stem 1 via rivet 9. The fixed plug 5 is provided with a pulley groove 5.3 in the lower part, the large pulley 6 and the small pulley 8 is placed in the pulley groove 5.3 and pivotally connected with the pin hole 5.2 on the fixed plug 5 via pins 10 and 11. The fixed plug 5 is also provided with a through hole 5.4 for insertion of the umbrella string. The fixed plug 5 is also provided with a ring boss 5.5 at the bottom, which is surrounded by the top of an upper return spring 12.

The structure of the upper sliding plug 17 is completely the same to that of the fixed plug 5. The small pulley 13 and the large pulley 15 is placed in the pulley groove in the upper section of the upper sliding plug 17 and pivotally connected with pin holes of the upper sliding plug 17 via pins 14 and 16. The upper sliding plug 17 is provided at the bottom with a rectangular groove 17.1 for the insertion of the top of the sliding rod 20. A through hole is provided in the vertical direction, said through hole is aligned with the through hole 20.1 at the top of the sliding rod 20 and is fixed with the connecting pin 19.

During the assembly, the fast pulley 3 is fixed in the pulley groove 1.1 of the upper section of umbrella stem 1 via rivet 2, the large pulley 6 is placed at the bottom of the pulley groove 5.3 of the fixed plug 5, the small pulley 8 is placed outside of the pulley groove 5.5 of the fixed plug 5 and fixed with the fixed plug 5 via pin 10 and pin 11. The upper part of the upper return spring 12 surrounds the ring boss 5.5 of the fixed plug 5, the lower part of said upper return spring 12 surrounds corresponding ring boss on the upper sliding plug 17. The small pulley 13 and the large pulley 15 are placed in the pulley groove of the upper sliding plug 17 and connected with the upper sliding plug 17 via pin 14 and pin 16. One end of said umbrella string 4 is fixed with the lower nest 27, and then pass the fast pulley 3, and then the other end of said umbrella string 4 passes through the through hole 5.4 of fixed plug 5 for insertion of the umbrella string, the upper return spring 12, the small pulley 13 fixed on the upper sliding plug 17, and then the upper return spring 12 upwards, then the small pulley 8 of the fixed plug 5, and then the upper return spring 12 downwards, the large pulley 15 of the upper sliding plug 17, then the upper return spring 12 upwards, then the large pulley 6 in the fixed plug 5, and the through holes on the upper return spring 12 and the upper sliding plug 17 for insertion of the umbrella string downwards, and then the upper section of bending 18 and the lower section of bending 23 to connected with a rotating handle 26 of the operation mechanism 25 on the lower section of bending 23. The umbrella string 4 pulls the umbrella nest 27 to move upwards, after the umbrella nest reaches ring 7, one end of the umbrella string is fixed, further shaking of the rotating handle 26 will apply the retraction force of the umbrella string on the upper sliding plug 17, the upper sliding plug 17 drives the sliding rod 20 to move upwards, and the guide pin 21 at the bottom of the sliding rod slides in the linear groove 18.3 of the upper section of bending 18 and the arc groove 23.3 of the lower section of bending 23 to make the upper section of bending 18 gradually deflect in relation to the lower section of bending 23 till the bending is achieved.

This bending device has 5 fast pulleys, the fast pulley 3, the large pulley 6 and small pulley 8 on the fixed plug are fixed via rivets or pins, small pulley 13 and large pulley 16 of the upper sliding plug 17 are connected with the sliding rod 20 and can move up and down, forming a group of movable pulleys. According to mechanical knowledge, the pull can be reduced by half with 1 movable pulley structure. 2 movable pulleys can reduce the pull down to ¼. Therefore, the whole structure may ensure smooth and labor-saving bending of the umbrella. Furthermore, since the umbrella string is wound for multiple times, the sliding rod will move a unit distance after the umbrella string moving 4 units of distance, thus ensuring more balanced bending and make the whole mechanism more practical.

Embodiment 3

Figure 10:
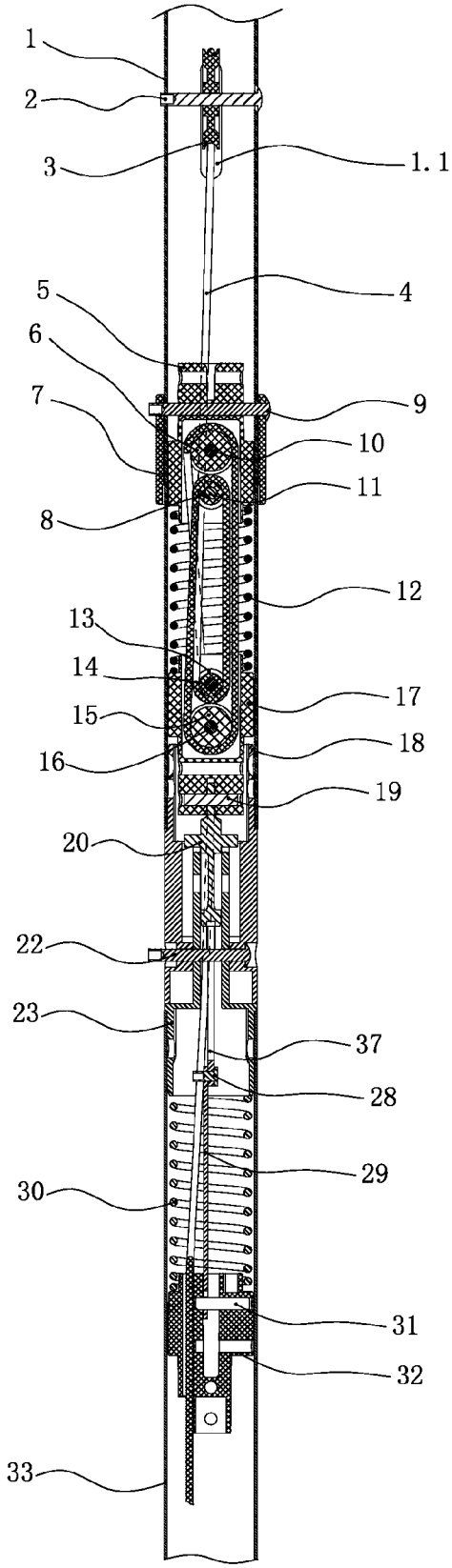
FIG. 10 is structural cutaway view 1 of embodiment 3 of the present invention.
Figure 11:
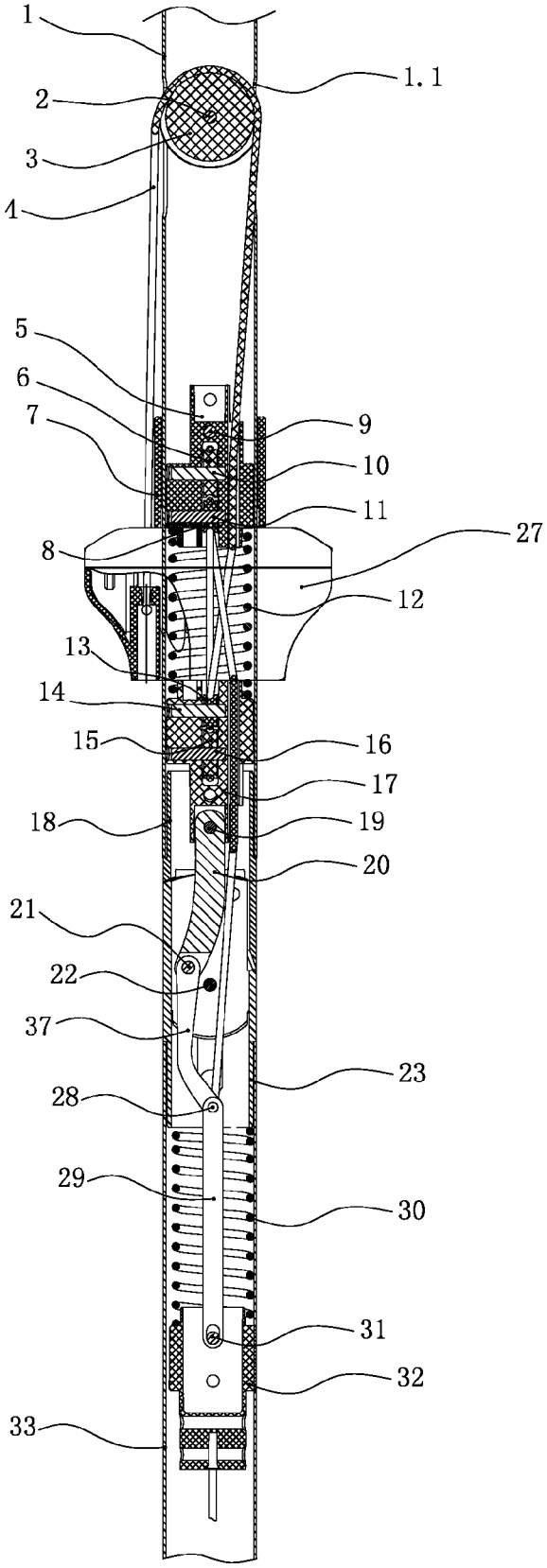
FIG. 11 is structural cutaway view 2 of embodiment 3 of the present invention.
Figure 12:
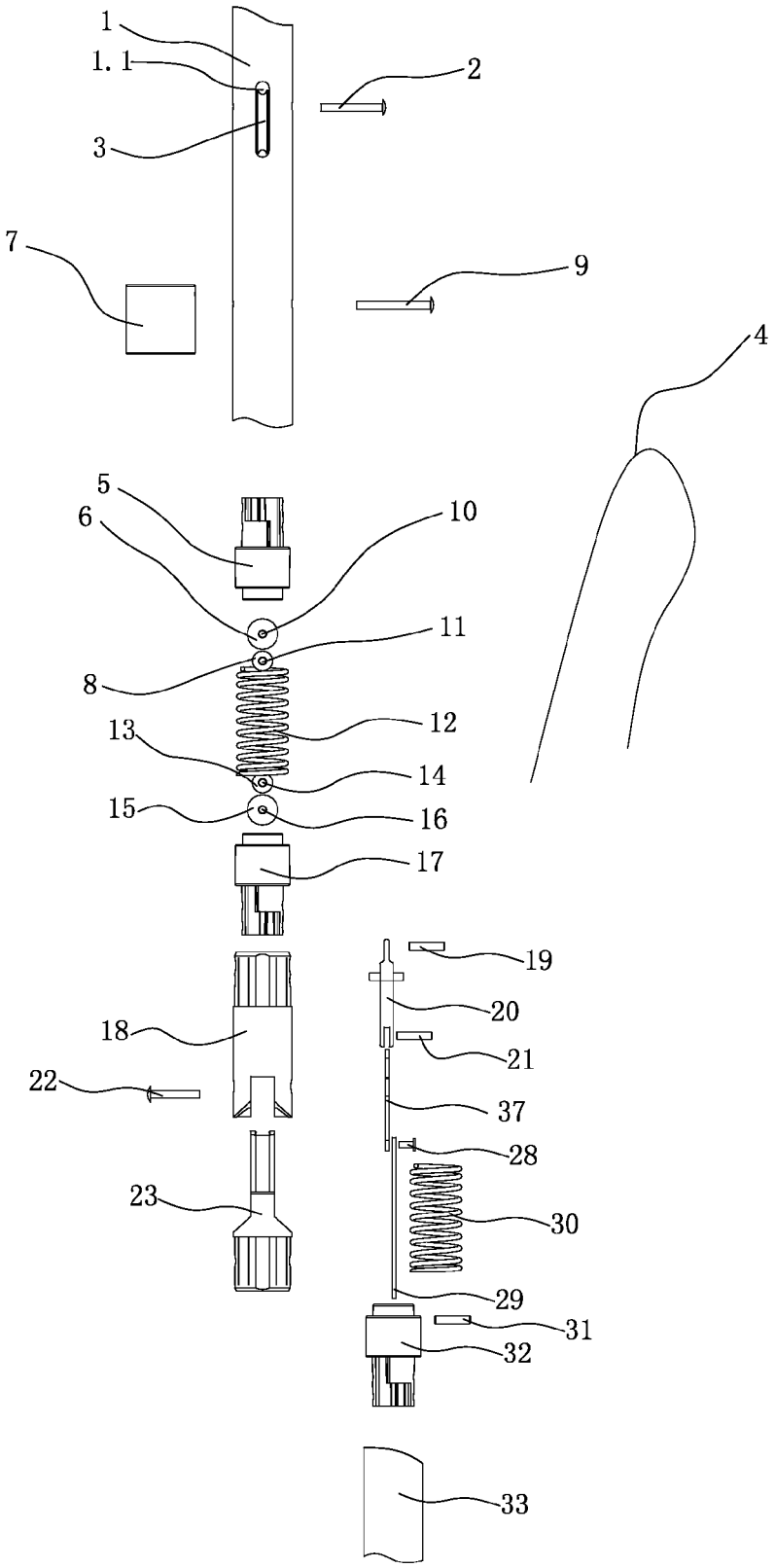
FIG. 12 is structural exploded view 1 of embodiment 3 of the present invention.
Figure 13:
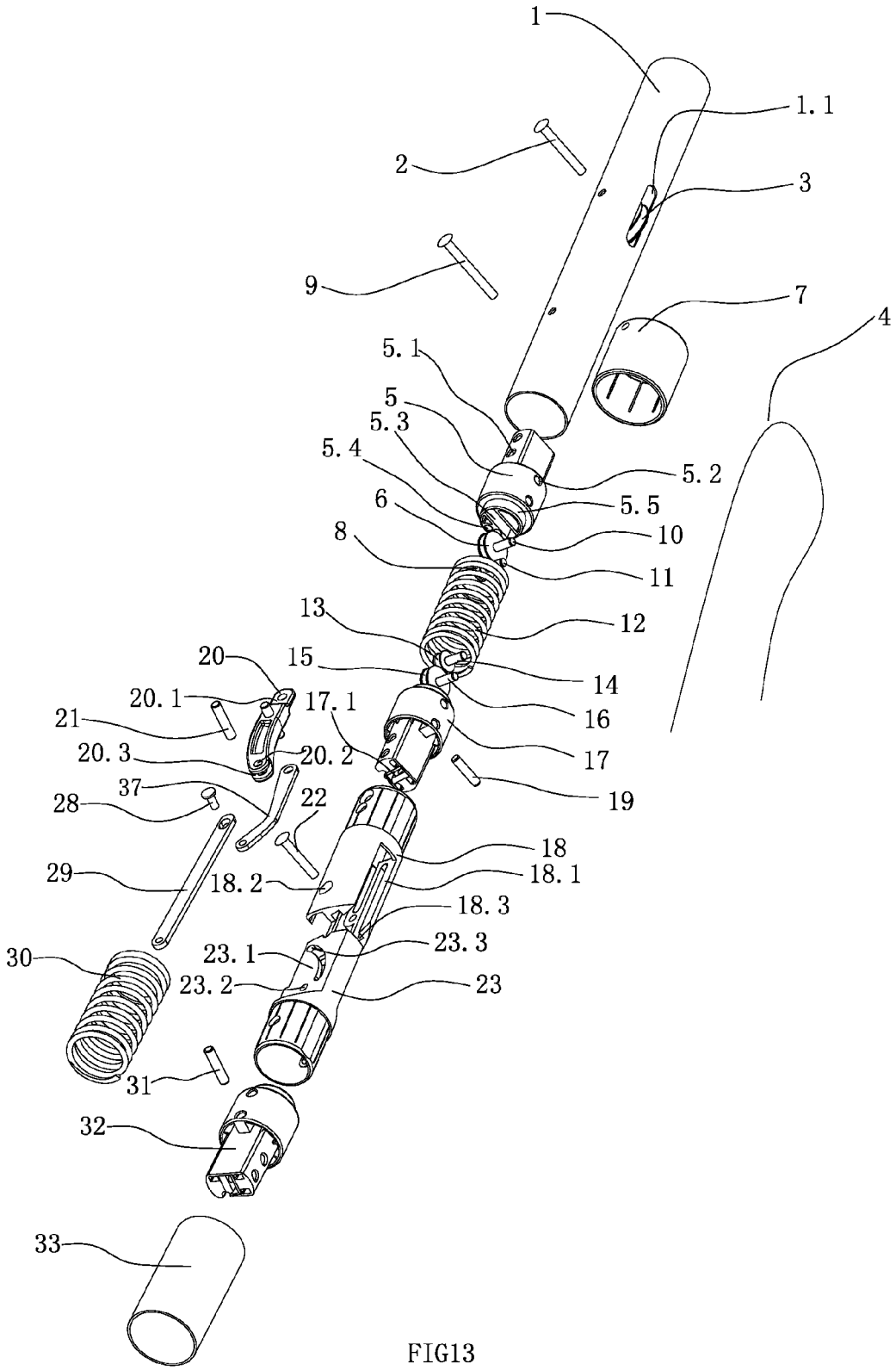
FIG. 13 is structural exploded view 2 of embodiment 3 of the present invention.

As shown in FIGS. 10-13, said auto bending structure of sunshade comprises the upper section of bending 18, lower section of bending 23, upper section of umbrella stem 1, fixed plug 5, upper sliding plug 17, lower sliding plug 32, first connecting rod 37, second connecting rod 29 as well as the umbrella string 4, the umbrella fabric 24 and the umbrella frame, etc.

Both sides of one end of the lower section of bending 23 are cut even into a flat scarf joint part 23.1, which is provided with a through hole 23.2 in the middle, 2 arc groove 23.3 are provided on both sides of the scarf joint part 23.1 of said lower section of bending 23, a slot 18.1 is provided on the top of said upper section of bending 18, said slot 18.1 and scarf joint part 23.1 of said lower section of bending 23 are corresponding, through holes 18.2 are provided on both sides of slot 18, s scarf joint part 23.1 of said lower section of bending 23 is embedded in slot 18.1, through hole 23.2 passing through the lower section of bending 23 via rivet 22 and the through hole 18.2 of the upper section of bending 18 pivotally connected the lower section of bending 23 and the upper section of bending 18 to allow rotation between said lower section of bending 23 and upper section of bending 18, upper section of bending slot 18.1 is also provided with 2 linear groove 18.3 corresponding to the arc groove 23.3 of lower section of bending 23, a sliding rod 20 is provided in the pivotally connected upper section of bending 18 and lower section of bending 23, said sliding rod 20 is with an arc, through holes 20.1, 20.2 are provided on the top and bottom of the sliding rod 20, a linear groove 20.3 in provided vertical to the through hole 20.2 of the sliding rod 20, the first connecting rod 37 is provided below the sliding rod 20, said first connecting rod 37 is provided with through hole at the top and bottom, the top of said first connecting rod 37 is inserted into the linear groove 20.3 at the bottom of the sliding rod 20, the through hole 20.2 at the bottom of the sliding rod 20 is aligned with the through hole on the top of the first connecting rod 37, a guide pin 21 crosses the through hole 20.2 at the bottom of the sliding rod 20 and the through hole on the top of the first connecting rod 37, said guide pin 21 can be movably inserted in the linear groove 18.1 of said upper section of bending 18 and the arc groove 23.3 of the lower section of bending 23, in the lower section 33 of the umbrella stem, the lower sliding plug 32 and the second connecting rod 29 are provided below the lower section of bending 23, the second connecting rod 29 is provided with through hole at the bottom and top to pivotally connect the top of the second connecting rod 29 and the lower end of the first connecting rod 37 via the rivet 28, the lower sliding plug 32 is provided with a linear groove on the top, a through hole is provided vertical to said linear groove, the bottom end of the second connecting rod 29 is inserted in the linear groove of the lower sliding plug 32, and the bottom through hole of the second connecting rod 29 is aligned with the through hole on the lower sliding plug 32, the pin 31 passed the through hole of the second connecting rod 29 and the through hole on the lower sliding plug 32 for pivotal connection. The lower return spring 30 is supported between the lower section of bending 23 and the lower sliding plug 32. The lower sliding plug 32 is also provided with a through hole for insertion of the umbrella string 4.

The fast pulley 3 is placed in the pulley groove 1.1 of the upper section of umbrella stem 1 and is fixed via rivet 2 to make the fast pulley 3 pivotally connected in the upper section of umbrella stem 1.

The fixed plug 5 is provided in the upper section of umbrella stem 1 below the fast pulley 3, said fixed plug 5 is provided with a through hole on the top and is connected with the upper section of umbrella stem 1 and the ring 7 around the upper section of umbrella stem 1 via rivet 9. The fixed plug 5 is provided with a pulley groove 5.3 in the lower part, the large pulley 6 and the small pulley 8 is placed in the pulley groove 5.3 and pivotally connected with the pin hole 5.2 on the fixed plug 5 via pins 10 and 11. The fixed plug 5 is also provided with a through hole 5.4 for insertion of the umbrella string. The fixed plug 5 is also provided with a ring boss 5.5 at the bottom, which is surrounded by the top of said upper return spring 12.

The structure of the upper sliding plug 17 is completely the same to that of the fixed plug 5. The small pulley 13 and the large pulley 15 is placed in the pulley groove in the upper section of the upper sliding plug 17 and movably connected with pin holes of the upper sliding plug 17 via pins 14 and 16. The upper sliding plug 17 is provided at the bottom with a rectangular groove 17.1 for the insertion of the top of the sliding rod 20. A through hole is provided in the vertical direction, said through hole is aligned with the through hole 20.1 at the top of the sliding rod 20 and is fixed with the connecting pin 19.

During the assembly, the fast pulley 3 is fixed in the pulley groove 1.1 of the upper section of umbrella stem 1 via rivet 2, the large pulley 6 is placed at the bottom of the pulley groove 5.3 of the fixed plug 5, the small pulley 8 is placed outside of the pulley groove 5.5 of the fixed plug 5 and fixed with the fixed plug 5 via pin 10 and pin 11. The upper part of the upper return spring 12 surrounds the ring boss 5.5 of the fixed plug 5, the lower part of said upper return spring 12 surrounds corresponding ring boss on the upper sliding plug 17. The small pulley 13 and the large pulley 15 are placed in the pulley groove of the upper sliding plug 17 and connected with the upper sliding plug 17 via pin 14 and pin 16. One end of said umbrella string 4 is fixed with the lower nest 27, and then the other end of umbrella string 4 pass the fast pulley 3, and then pass through the through hole 5.4 of fixed plug 5 for insertion of the umbrella string, the upper return spring 12, the small pulley 13 fixed on the upper sliding plug 17, and then the upper return spring 12 upwards, then the small pulley 8 of the fixed plug 5, and then the upper return spring 12 downwards, the large pulley 15 of the upper sliding plug 17, then the upper return spring 12 upwards, then the large pulley 6 in the fixed plug 5, and the upper return spring 12 and the through holes on the upper sliding plug 17 for insertion of the umbrella string downwards, and then the upper section of bending 18 and the lower section of bending 23, the lower return spring 30 and the through hole on the lower sliding plug 32 and is connected with the rotating handle 26 of the operation mechanism 25. The umbrella string 4 pulls the umbrella nest 27 to move upwards, after the umbrella nest reaches ring 7, one end of the umbrella string 4 is fixed, further shaking of the rotating handle 26 will apply the retraction force of the umbrella string on the upper sliding plug 17, the upper sliding plug 17 drives the sliding rod 20 to move upwards, and the guide pin 21 at the bottom of the sliding rod 20 slides in the linear groove 18.3 of the upper section of bending 18 and the arc groove 23.3 of the lower section of bending 23 to make the upper section of bending 18 gradually deflect in relation to the lower section of bending 23 till the bending is achieved.

What is claimed is:

1. An auto bending structure of sunshade comprising:

an upper section of bending and an lower section of bending, both sides of one end of said lower section of bending are cut even into a flat scarf joint part, which is provided with a through hole in the middle; a bottom of said upper section of bending is provided with a groove corresponding to said scarf joint part, through holes are provided on both sides of said groove, the scarf joint part of said lower section of bending is inserted in said groove, said lower section of bending and said upper section of bending are connected in pivot by a rivet, a return spring is provided inside of an upper section of an umbrella stem, one end of an umbrella string is fixed with a lower nest, and the other end of the umbrella string is connected with a rotating handle after passing fast pulley in the upper section of umbrella stem and passing through the return spring, the upper section of bending and the lower section of bending in order; wherein a sliding rod is placed in the upper section of bending and lower section of bending, through holes are provided on the bottom and top of said sliding rod, a guide pin is provided at the through hole on the bottom of said sliding rod, an arc groove for said guide pin to slide on is provided is on the scarf joint part of the lower section of bending, linear groves corresponding to said arc groove for said guide pin to slide on are provided on both sides of said groove of the upper section of bending, inside the upper section of umbrella stem, a fixed plug and an upper sliding plug capable of moving up and down are provided, said fixed plug is provided with a through hole on the upper part and is connected with the upper section of umbrella stem and a ring around said upper section of umbrella stem with a rivet, the lower part of said upper sliding plug and the top of said sliding rod are pivotally connected, through holes are provided on said fixed plug and upper sliding plug for the umbrella string to pass through, the upper return spring is mounted between said fixed plug and said upper sliding plug, the umbrella string at least passes through said fixed plug, the upper return spring and the upper sliding plug in order before being connected with the rotating handle to make the ring cooperate with the lower nest moving up and down and pulled by the umbrella string so as to realize direction adjustment between said upper section of bending and said lower section of bending.

2. The auto bending structure of sunshade according to claim 1, wherein said fixed plug is provided with a pulley groove on the bottom, in which at least one pulleys are placed for pivotal connection with said fixed plug, said upper sliding plug is provided with a pulley groove on the top, in which at least one pulleys are placed for pivotal connection with said upper sliding plug, the number of pulleys of the fixed plug corresponds to that of the pulleys of said upper sliding plug to allow the umbrella string to pass the pulleys of the fixed plug and the upper sliding plug.

3. The auto bending structure of sunshade according to claim 2, wherein said fixed plug has a pair of pulleys, one large and one small, with the large pulley on the top and the small pulley on the bottom; correspondingly, the upper sliding plug also has a pair of pulleys, one large and one small, with the small pulley on the top and the large pulley on the bottom.

4. The auto bending structure of sunshade according to claim 3, wherein the bottom of said sliding rod is tunably connected with the top of the first connecting rod, while the bottom of said first connecting rod is tunably connected with the top of a second connecting rod in a lower section of the umbrella stem, the bottom of said second connecting rod is tunably connected with a lower sliding plug in the lower section of the umbrella stem, the lower return spring is supported between the lower section of bending and the lower sliding plug.

5. The auto bending structure of sunshade according to claim 3, wherein said fixed plug is provided with a boss at the bottom, said upper sliding plug is provided with a boss on the top, and the upper return spring is provided between the bosses.

6. The auto bending structure of sunshade according to claim 3, wherein said fast pulley is provided in a pulley groove of the upper section of umbrella stem and is tunably connected with the upper section of umbrella stem by a rivet.

7. The auto bending structure of sunshade according to claim 3, wherein said upper sliding plug is provided with a rectangular groove at the bottom for insertion of the top of the sliding rod, and a through hole is provided in the vertical direction, said through hole is aligned with the through hole on the top of said sliding rod and connected with a connecting pin.

8. The auto bending structure of sunshade according to claim 3, wherein said sliding rod is with an arc.

* * * * *